United States Patent [19]

Hsu

[11] Patent Number: 4,599,059

[45] Date of Patent: Jul. 8, 1986

[54] ROTARY COMPRESSOR WITH NON-PRESSURE ANGLE

[76] Inventor: Song K. Hsu, 4/F 27 Lane 160, Hsin Sheng S. Rd., Sec. 1, Taipei, Taiwan

[21] Appl. No.: 642,243

[22] Filed: Aug. 20, 1984

Related U.S. Application Data

[63] Continuation-in-part of Ser. No. 327,206, Dec. 3, 1981, abandoned.

[51] Int. Cl.[4] ..... F01C 21/10

[52] U.S. Cl. ..... 418/236; 418/238; 418/248

[58] Field of Search ..... 418/243–249, 418/270, 236, 238

[56] References Cited

U.S. PATENT DOCUMENTS 3,797,464 3/1974 Abbey ..... 418/248

4,137,018 1/1979 Brucken ..... 418/238

*Primary Examiner*—Leonard E. Smith

*Assistant Examiner*—Jane E. Obee

*Attorney, Agent, or Firm*—Nies, Webner, Kurz & Bergert

[57] ABSTRACT

A rotary compressor comprising a cylindrical stator, a rotor rotatably mounted within the stator defining a number of stator chambers, a plurality of gas-blocking vanes equiangularly disposed between the inner peripheral surface of the stator and the outer surface of the rotor, wherein the outer peripheral surface of the rotor is formed with a plurality of wavy compressive surfaces and the center line of said vanes are not aligned with the center of the rotor so as to make the pressure angle between the vanes and the rotor approach 0° during the performance of the compression work, so that the frictional resistance formed between the rotor and the vanes will be reduced to the minimum.

5 Claims, 10 Drawing Figures

ROTARY COMPRESSOR WITH NON-PRESSURE ANGLE

This is a continuation-in-part, of application Ser. No. 327,206 filed on Dec. 3, 1981, now abandoned.

BACKGROUND OF THE INVENTION

The present invention relates to a compressor and, more particularly, to a rotary compressor for compressing refrigerant, suitable for use in air conditioners for automobilies wherein the pressure angle and the side thrust formed between the vane and the rotor almost comes to 0° so as to save the driving power and to increase compression efficiency of the compressor.

According to the conventional rotary compressor, whatever the outer peripheral surface or rotor, the center line of the gas-blocking vanes are mostly aligned with the center of the rotor, which usually causes a large pressure angle which is formed between the centerline of the vane and the normal line of the contacting curved surface of both the vane and the rotor when the rotor rotates. The pressure angle usually causes an undesired side thrust between the vane and the inner wall of its guiding slot. The side thrust generates heat, not only to shortening the life of the vane but also to wasting the driving power and to lowering the efficiency of the compressor. Therefore, it is generally in considered desirable to prevent the pressure angle from attaining over 30° in designing a compressor. Nevertheless, it is inevitable that a pressure angle between the vane and the rotor for compressor or engine be formed.

For example, the hydraulic servo-mechanism of U.K. Pat. No. 1,394,138 provides for a pressure angle of about 45°; the balanced rotary combustion engline of U.S. Pat. No. 3,797,464 provides for a pressure angle of about 37°; and the rotary compressor with vanes in housing and suction through the rotor of U.S. Pat. No. 4,345,886 provides for pressure angle of about 27°. In other words, the current rotary compressors all provide for a relatively large pressure angle between vanes and the rotor, which cause an undesirable side thrust.

Therefore, an object of the present invention is to provide a novel rotary compressor which forms a non-pressure angle during the performance of the compression duty.

Another object of the present invention is to provide a novel rotary compressor which has a revolution speed of about 100 to 300 RPM to work as efficiently as a high revolution compressor, and consequently the compressor in accordance with the present invention may be driven by a low voltage DC motor, especially suitable for the automobile compressor.

Still another object of the present invention is to provide a novel compressor which is adaptable to be driven by a DC low-voltage DC motor, whereby, its compression efficiency will be constant without being influenced by the off-and-on of an automobile's traveling conditions.

A further object of the present invention is to provide a novel compressor which saves 33% of the driving power in comparison with the equivalent currently existing compressor.

This and other objects of the invention will become clear from the following description of the preferred embodiment taken in conjunction with the accompanying drawings as well as from the appended claims.

DESCRIPTION OF THE PREFERRED EMBODIMENTS

Figure 1:
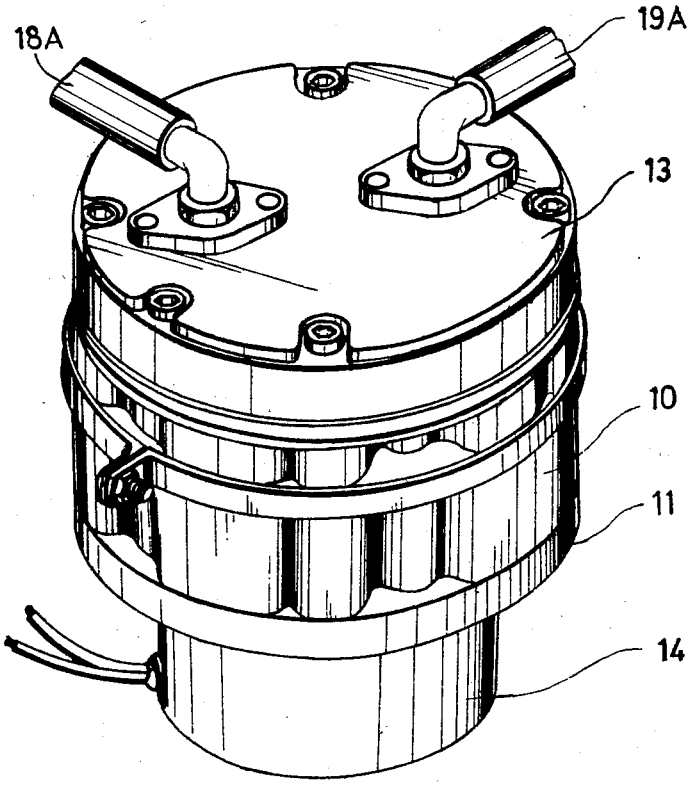
FIG. 1 is a perspective view of a compressor in accordance with the invention.

A first embodiment of the invention will be described hereinunder with reference to FIGS. 1 to 3. The rotary compressor of this invention mainly comprises a housing 10 having on outer peripheral surface and lower and upper end covers 11 and 13 for closing the longitudinal ends of the housing, a cylindrical stator 30 firmly mounted within said housng, a rotor 40 concentrically mounted within said stator 30, a driving means 14 provided near the lower end cover 11 including a motor and a gear reduction device (not shown in the drawing) a main shaft 44 of the rotor 40 which is driven by said driving means 14, four sets of gas-blocking vanes 31 equiangularly disposed in said housing 10 and extending into said cylindrical stator 30, a suction chamber 19 with an inlet port 35 and a delivery chamber 20 with a delivery port 36 provided to the rear of and in front of said vanes respectively in the direction of rotor movement, a before collection tube 19A for said suction chamber 19 and a collection tube 18A for delivery chamber 20 installed on the top of the upper end cover 13. The outer peripheral surface of the rotor 40 is formed with a plurality of complete working cycles comprising continuous and smooth wavy compressive surfaces with a sharp curved rotor edge between each two wavy surfaces, each compressive surface including a regular alternating sinusoid convex surface 41 and sinusoid concave surface 42 which are brought into contact with movable gas-blocking vanes 31–31 alternating sinusoid convex surface 41 and sinusoid concave surface 42 are contractibly and extensibly fixed between the housing 10 and the stator 30.

Figure 2:
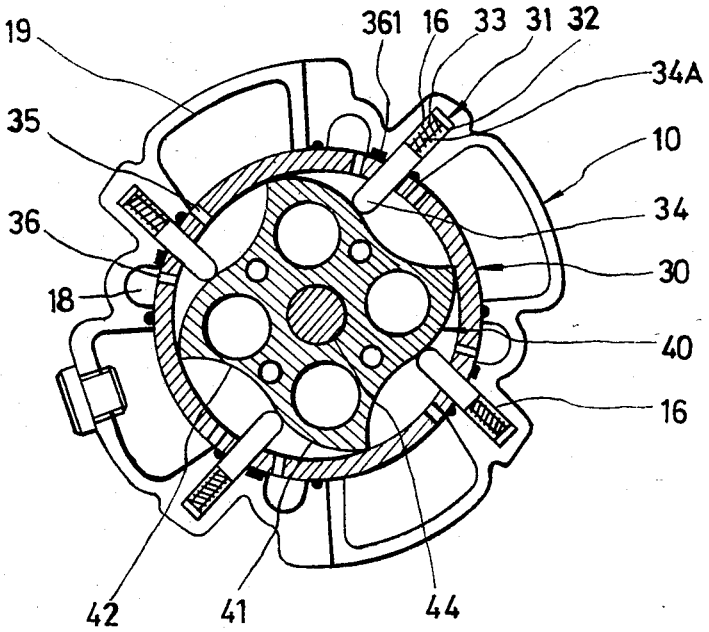
FIG. 2 is a sectional view of a compressor constructed in accordance with a first embodiment of the invention.
Figure 3:
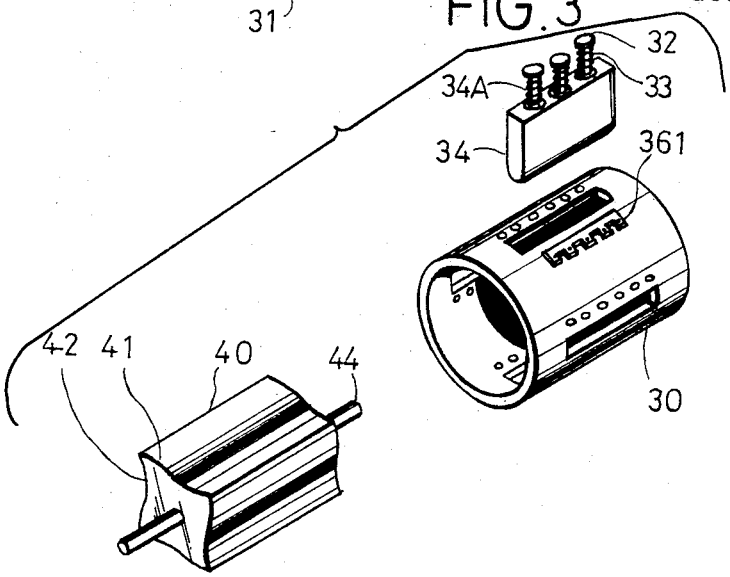
FIG. 3 is an explosive perspective view of the rotor, stator and gas-blocking vane of the compressor in accordance with the same embodiment of the invention.

As will be seen from FIG. 2, in order to obtain a better coaling effectiveness, the outer periphery of the housing 10 is formed with a curved surface, the inner periphery of which has formed with an aperature for firmly receiving said cylindrical stator 30.

According to this embodiment of the present invention, each vane 31 is moveably mounted within a vane slot 16, the direction of each vane slot 16 oriented to be offset from the center of the rotor 40 by a leading angle with respect to the rotational direction of the rotor, as shown in FIGS. 2 and 4, and each vane slot 16 also extends through the entire thickness of the wall of cylindrical stator 30 so that upon insertion of said vane 31 into said slot 16, before the center lines of each two opposed vanes of this embodiment parallel to each other by offsetting their respective centerlines from the center of the rotor with a leading angle (not a lagging angle). Thus, the pressure angle of each vane 31 will approach 0° during the compression work. This fact can be readily seen when the vanes are in the position shown in FIGS. 2 and 4C, which will be discussed hereinafter.

At the front edge of the vane 31 with respect to the direction of rotor movement, an inlet port 35 is provided to communicate with said suction chamber 19 and at the rear edge of the vane 31 with respect to the direction of rotor movement, a delivery port 36 is provided to communicate with delivery chamber 18, wherein a one-way check valve is further installed at the delivery port 36 to prevent the compressing fluid from being fed back. Fluid from each suction chamber 19 and delivery chamber 18 is separately collected to respective collection tubes 19A and 18A which are disposed at after the upper end cover 13 of the housing 10.

Each gas-blocking vane 31 comprise a base 32 with supporting rod 34A thereon, a biased coil spring 33, and a movable front end 34 so as to allow the movable front end 34 of the to move freely in reciprocatory sliding movement to slide in sealing contact with the outer peripheral surface of the rotor and is biased by the spring 33 to perform the purpose of air sealing.

Figure 4A:
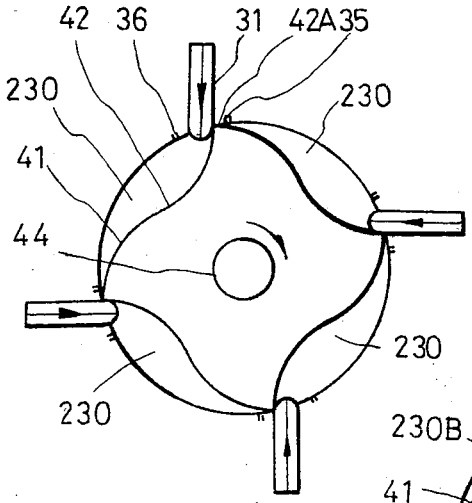
FIGS. 4A to 4D are illustrations for explaining the suction and delivery strokes performed by the rotor in a stator chamber.
Figure 4B:
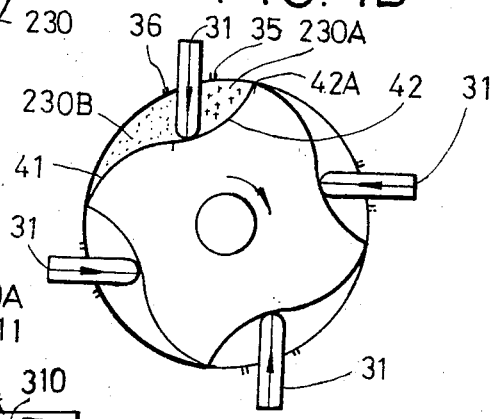
Figure 4C:
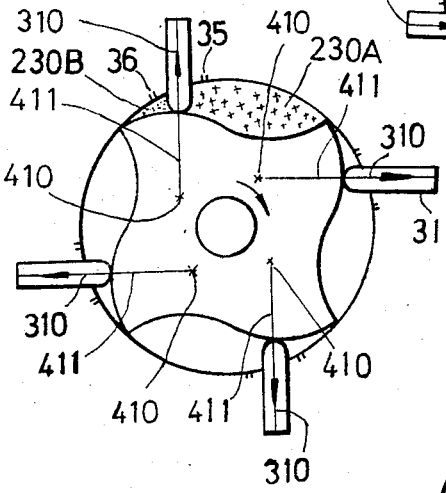

Referring to FIGS. 2 and 4C, the important features of the rotor 40 and the vane 31 of this invention will be described as follows. The outer peripheral surface of the rotor of the first embodiment of this invention is provided with four complete working cycles of continuous and smooth sinusoid wavy surfaces, each having a regular alternating sinusoid convex wave surface 41 and sinusoid concave wave surface 42; and the circle center 410 of each convex wave surface is located at the inner portion of the rotor as shown in FIG. 4C. The center lines 310—310 of said vanes are offset from the center of rotor 30 by a leading angle. That is, each of the vanes 31 is fixed in such a way that the centerline 310 of each vane 31 is offset from the center of the rotor 40 by a leading angle (but not a lagging angle) with respect to the direction of rotor movement. Thus, the two corresponding opposed vanes are not provided at diametrically opposed positions. In this manner, it will be clearly noted that during operation when the inner end of each said vane 31 engages with a portion of the sinusoid concave wave surface of said wavy compresssive surface of said rotor and extends to said stator chamber, due to said concave wavy surface inducng said vane inwardly to said stator chamber, said vane applies no pressure on said sinusoid concave wave surface of said rotor so that no side thrust between the guiding slot 16 and said vane 31 is produced during the half cycle of suction working in said stator chamber, and when the inner end of each said vane engages with a portion of the sinusoid convex wave surface of said wavy compressive surface of said rotor, said vane begins to contract outwardly by the rotation movement of said convex wave surface of said rotor and causes before the centerline 310 of the path of the vane is overlapped (no angle formed therebetween) with the common normal line 411 of the contacting point of convex wave surface 41 of the rotor 40 and the vane 31. The pressure angle which is formed by the common normal line 411 for the contacting point of the rotor 40 and the vane 31 and the path 310 of the vane is almost 0° , which means that a non-pressure angle is formed during the compression work means that non-pressure angle is formed between the movement of the vane and the rotation of the rotor. Therefore, the side thrust between vanes 31—31 and the rotor 40 as well as the side thrust between the guiding slots 16—16 and its respective vane 31 also approaches 0°. In other words, under the conditions mentioned above, this invention will decrease the frictional resistance to the minimum for the vanes in compression work, and the driving power needed for the rotor will be completely utilized to allow the compressor of this invention to use the least driving power compared to the equivalent capacity of conventional rotary compressors. It is evident that the compressor of this invention is suitable for being driven by a low voltage DC motor, and more particularly suitable for the automobile compressor in which 12-volt DC power supply is buit-in, thus it will perform stable compression work, rating higher compression efficiency without being influenced by off-and-on changing of the running speed of the automobile.

The compressor of the present invention having the construction described operates in the manner described hereinafter with reference to FIGS. 4A to 4D.

Referring first to FIG. 4A, leading edge 42A of the concave wave surface of the rotor 40 is positioned to confront the uppermost vane 31. At this instant there are four stator chambers 230—230 defined by four vanes 31—31 which are disposed at 90° intervals along the inner peripheral surface of the cylindrical stator between adjacent vanes and the outer surface of the rotor 40.

Figure 4D:
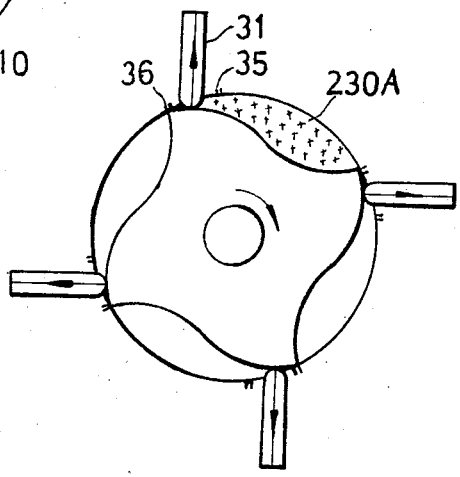

For a better understanding of the invention, the description will be be made specifically in connection with one of the stator chambers 230 (marked portion in FIGS. 4B to 4D).

As the rotor 40 rotates clockwise from the position, shown in FIG. 4A, the stator chamber 230 will be divided as shown in FIG. 4B into two working chamber 230A and 230B. The vane 31 moves inwardly against the concave wave surface 42 of the rotor 40. In this manner, the working chamber 230A has a volume which is gradually increasing, so that a vacuum is generated therein. As a result, the refrigerant in suction chamber 19 is sucked into the working chamber 230A through the inlet port 35. At this instant, the volume of the other working chamber 230B is gradually decreased to produce a high pressure therein, so that the refrigerant in the working chamber 230B is compressed and delivered to the delivery chamber 20 through the delivery port 36.

As the rotor 40 is further rotated to the position as shown in FIG. 4C, the vane 31 move outwardly against the convex wave surface 41 of the rotor 40. Meanwhile, the vacuum of working chamber 230A is further increased and refrigerant in the working chamber 230B is further compressed.

As the rotor 40 is rotated further to the position as shown in FIG. 4D, the working chamber 230B is extinguished to complete while the compression, the working chamber 230A is opened to its maximum intake space.

The working chamber 230A in this state has the maximum suction volume.

Compression will be commenced as the working chamber 230B is restored as the rotor 40 is further rotated.

The suction and compression strokes are performed simultaneously in the other three stator chamber 230—230—230 in the same manner as that of the stator chamber 230 mentioned above.

In the foregoing described embodiment, each stator chamber makes four compression strokes during one rotation of the rotor 40. This means that the total volume of the frigerant introduced and compressed by the compressor is 16 times a large as that of the aforementioned maximum suction volume.

Figure 6:
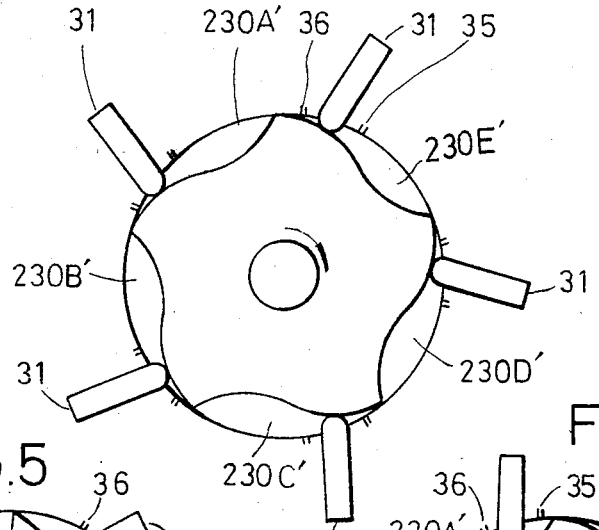
FIG. 6 is a schematic illustration of a compressor constructed in accordance with a third embodiment of the invention.
Figure 5:
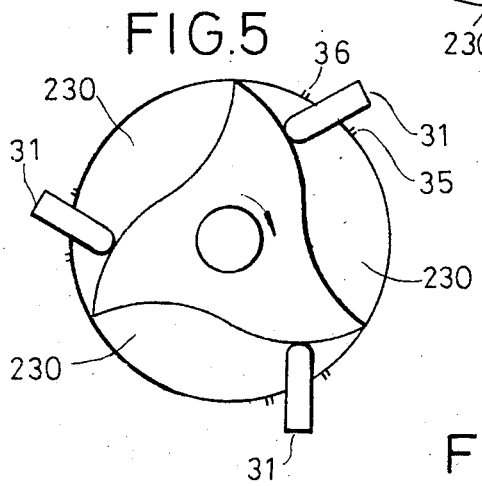
FIG. 5 is a schematic illustration of a compressor constructed in accordance with a second embodiment of the invention.

It is clearly to be understood that in the foregoing described embodiment of the present invention, four sets of gas-blocking vanes correspond to four complete working cycles of wavy surfaces on the outer peripheral surface of the rotor. In a similar manner, according to the second embodiment of the present invention, the number of gas-blocking vanes and the number of wavy surfaces of the rotor can be at least three, as shown in FIG. 5, it preforming the same function as above. However, each stator chamber makes three compression and suction strokes during one rotation of the rotor 40, so that nine compressive cycles will be obtained for each revolution of the rotor 40. Also, in accordance with the third embodiment of the present invention, the number of gas-blocking vanes and respective wavy surfaces on the rotor can be of five, as shown in FIG. 6.

This construction of compressor will also perform the same function as above, but one revolution of the rotor 40 results in 25 compressive cycles.

Figure 7:
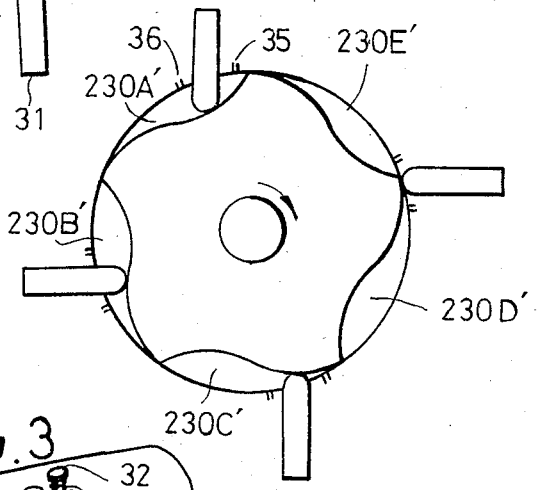
FIG. 7 is a schematic illustration of a compressor constructed in accordance with a fourth embodiment of the invention.

Of course, the number of gas-blocking vanes of the thrid embodiment of this invention can be decreased to four and the number of corresponding wavy surfaces on the rotor 40 may remain unchanged, as shown in FIG. 7. According to the embodiment of this invention, the compression work done in the stator chamber is in the sequence 230A', 230B', 230C', 230D', 230E'. This means that the power needed for driving the rotor will be less than that of the third embodiment of this invention as shown in FIG. 6. Moreover, it will also be appreciated that twenty compression cycles can be obtained for each revolution of the rotor 40.

Although the invention has been described in detail to some extent through specific preferred embodiments, these embodiment are not exhaustive and, as will be clearly understood by those skilled in the art, various changes and modification may be imparted thereto, without departing from the spirit and scope of the invention which are solely limited by the statement of the appended claims.

I claim:

1. A rotary compressor comprising:

a housing having upper and lower end covers for closing longitudinal ends of the housing:

a cylindrical stator firmly fixed within said housing:

a driving means provided at the lower end cover of said housing;

a rotor concentrically mounted within said cylindrical stator defining a plurality of stator chamber between the inner surface of said cylindrical stator and the outer peripheral surface of said rotor, the shaft of said rotor connected to said driving means, said rotor having a plurality of compressive wavy surfaces on the outer peripheral surface thereof, each said wavy compressive surface including a complete working cycle of continuous and smooth wavy surface, each having a regular alternating sinusoid convex wave surface and a sinusoid concave wave surface contiguous therewith;

a sharp curved rotor edge formed between each two wavy compressive surface of said rotor oriented in a direction opposite to the direction of the rotor movement, which is formed by the connection of the head portion of said sinusoid concave wave surface and the tail portion of said sinusoid convex wave surface with respect to the direction of the rotor movement;

a plurality of gas-blocking vanes equiangularly disposed in said housing and extending into said cylindrical stator, the inner ends of said gas-blocking vanes being adapted to engage with said wavy compressive surface of said rotor in contractibly and extensibly sliding contact for the purpose of air-tight sealing so that each of said stator chambers is divided into a first and second working chamber wherein the centerline of each said vane is oriented to be offset from the center of said rotor whereby during operation when the inner end of each said vane engages with a portion of the sinusoid concave wave surface of said wavy compressive surface of said rotor and extends to said stator chamber due to said concave wave surface inducing said vane inwardly to said stator chamber, side thrust is reduced to zero during a half cycle of suction working in said stator chamber, and when the inner end of each said vane engages with a portion of the sinusoid convex wave surface of said wavy compressive surface of said rotor, said vane begins to contract outwardly by the rotation movement of said convex wave surface of said rotor and causes the centerline of the path of the vane to overlap with the common normal line of the contacting point of convex wavy surface of the rotor and the vane so that the pressure angle of said vane with respect to said wavy compressive surface of the rotor approaches 0° during a next half cycle of compression working in said stator chamber;

a separate suction chamber provided between said housing and said cylindrical stator adjacent each vane at a position subsequent to the vane in the direction of rotor movement;

an inlet port near each vane at a position subsequent to the vane in the direction of rotor movement and communicating with said first working chamber and said suction chamber;

a delivery chamber provided between said housing and said cylindrical stator adjacent each vane at a position in advance of the vane in the direction of rotor movement; and a delivery port near each vane at a position in advance of the vane in the direction of rotor movement and communicating with said second working chamber and said delivery chamber.

2. A rotary compressor as claimed in claim 1, wherein the number of said gas-blocking vanes is the same as that of said compressive wavy surfaces on the outer peripheral surface of the rotor.

3. A rotary compressor as claimed in claim 1, wherein the number of said gas-blocking vanes is one less than that of said compressive wavy surfaces on the outer peripheral surface of the rotor.

4. A rotary compressor as claimed in claim 1, wherein four gas-blocking vanes are provided within the inner space of said cylindrical stator at 90° intervals.

5. A rotary compressor as claimed in claim 1, wherein five gas-blocking vanes are provided within the inner space of said cylindrical stator at 72° intervals.

* * * * *

UNITED STATES PATENT AND TRADEMARK OFFICE

CERTIFICATE OF CORRECTION

PATENT NO. : 4,599,059

DATED : July 8, 1986

INVENTOR(S) : Song K. Hsu

It is certified that error appears in the above-identified patent and that said Letters Patent is hereby corrected as shown below:

Column 2, line 43, cancel "before".

Column 2, lines 53-55, cancel "alternating sinusoid convex surface 41 and sinusoid concave surface 42" and insert --which--.

Column 2, line 58, "coaling" should be --cooling--.

Column 3, line 20, cancel "after".

Column 3, line 25, after "the" insert --vane--.

Signed and Sealed this

*Thirtieth* Day of *September 1986*

[SEAL]

*Attest:*

DONALD J. QUIGG

*Attesting Officer* *Commissioner of Patents and Trademarks*